US007748375B2

(12) United States Patent
Schultz

(10) Patent No.: US 7,748,375 B2
(45) Date of Patent: Jul. 6, 2010

(54) NEGATIVE PRESSURE CONDITIONING DEVICE WITH LOW PRESSURE CUT-OFF

(75) Inventor: Michael W. Schultz, Elk River, MN (US)

(73) Assignee: Honeywell International Inc., Morristown, NJ (US)

( * ) Notice: Subject to any disclaimer, the term of this patent is extended or adjusted under 35 U.S.C. 154(b) by 221 days.

(21) Appl. No.: 11/565,458

(22) Filed: Nov. 30, 2006

(65) Prior Publication Data

US 2007/0117056 A1 May 24, 2007

Related U.S. Application Data

(63) Continuation-in-part of application No. 11/164,083, filed on Nov. 9, 2005.

(51) Int. Cl.
*F24H 9/02* (2006.01)

(52) U.S. Cl. ..... 126/116 A; 431/12; 431/19; 126/116 R; 200/81 R

(58) Field of Classification Search ..... 431/19, 431/12; 126/116 A, 512; 200/81 R, 83 A
See application file for complete search history.

(56) References Cited

U.S. PATENT DOCUMENTS 4,251,025 A 2/1981 Bonne et al.
4,314,441 A 2/1982 Yannone et al.
4,329,138 A 5/1982 Riordan
4,334,855 A 6/1982 Nelson
4,340,355 A 7/1982 Nelson et al.
4,373,897 A 2/1983 Torborg
4,439,139 A 3/1984 Nelson et al.
4,502,625 A 3/1985 Mueller
4,533,315 A 8/1985 Nelson
4,684,060 A 8/1987 Adams et al.
4,688,547 A 8/1987 Ballard et al.
4,703,795 A 11/1987 Beckey
4,708,636 A 11/1987 Johnson
4,729,207 A * 3/1988 Dempsey et al. ..... 126/112
4,767,104 A 8/1988 Plesinger
4,819,587 A 4/1989 Tsutsui et al.
4,892,245 A 1/1990 Dunaway et al.
4,915,615 A 4/1990 Kawamura et al.
5,026,270 A 6/1991 Adams et al.

(Continued)

OTHER PUBLICATIONS

Honeywell, "45.801.175, Amplification Gas/Air Module for VK4105R/VK8105R Gas Controls," Production Handbook, 8 pages, prior to Oct. 18, 2006.

(Continued)

*Primary Examiner*—Kenneth B Rinehart
*Assistant Examiner*—Chuka C Ndubizu
(74) *Attorney, Agent, or Firm*—Gregory Ansems; Honeywell International Inc.

(57) ABSTRACT

A pneumatic signal conditioning device may have a first fluid path and a second fluid path. The first fluid path includes a first inlet and a first outlet, and is configured such that the first outlet provides a first conditioned signal representing a pressure at the first inlet. Similarly, the second fluid path is configured such that the second outlet provides a second conditioned signal representing a pressure at the second inlet. A pressure switch may be disposed in fluid communication with the first fluid path and the second fluid path such that the first fluid path and the second fluid path pass through the pressure switch.

16 Claims, 9 Drawing Sheets

U.S. PATENT DOCUMENTS 5,248,083 A 9/1993 Adams et al.
5,307,990 A 5/1994 Adams et al.
5,331,944 A 7/1994 Kujawa et al.
5,340,028 A 8/1994 Thompson
5,347,981 A * 9/1994 Southern et al. ..... 126/116 A
5,408,986 A 4/1995 Bigham
5,520,533 A 5/1996 Vrolijk
5,590,642 A 1/1997 Borgeson et al.
5,630,408 A 5/1997 Versluis
5,720,231 A 2/1998 Rowlette et al.
5,732,691 A 3/1998 Maiello et al.
5,791,332 A 8/1998 Thompson et al.
5,806,440 A 9/1998 Rowlette et al.
5,819,721 A 10/1998 Carr et al.
5,860,411 A 1/1999 Thompson et al.
5,865,611 A 2/1999 Maiello
5,993,195 A * 11/1999 Thompson ..... 431/19
6,000,622 A 12/1999 Tonner et al.
6,109,255 A 8/2000 Dieckmann et al.
6,254,008 B1 7/2001 Erickson et al.
6,257,870 B1 7/2001 Hugghins et al.
6,283,115 B1 9/2001 Dempsey et al.
6,321,744 B1 * 11/2001 Dempsey et al. ..... 126/116 A
6,354,327 B1 * 3/2002 Mayhew ..... 137/596
6,377,426 B2 4/2002 Hugghins et al.
6,571,817 B1 6/2003 Bohan, Jr.
6,705,533 B2 3/2004 Casey et al.
6,749,423 B2 6/2004 Fredricks et al.
6,758,909 B2 7/2004 Jonnalagadda et al.
6,764,298 B2 7/2004 Kim et al.
6,793,015 B1 9/2004 Brown et al.
6,846,514 B2 1/2005 Jonnalagadda et al.
6,866,202 B2 3/2005 Sigafus et al.
6,880,548 B2 4/2005 Schultz et al.
6,918,756 B2 7/2005 Fredricks et al.
6,923,643 B2 8/2005 Schultz et al.
6,925,999 B2 8/2005 Hugghins et al.
7,055,759 B2 6/2006 Wacker et al.
7,101,172 B2 * 9/2006 Jaeschke ..... 431/19
7,111,503 B2 9/2006 Brumboiu et al.
2002/0155405 A1 10/2002 Casey et al.
2003/0011342 A1 1/2003 Eichorn
2005/0155404 A1 7/2005 Geho et al.
2005/0159844 A1 7/2005 Sigafus et al.
2006/0105279 A1 5/2006 Munsterhuis et al.

OTHER PUBLICATIONS

Honeywell, "VK41 . . . R/VK81. . . R Series, Gas Controls with Integrated Gas/Air Module for Combined Valve and Ignition System," Instruction Sheet, 6 pages, prior to Oct. 18, 2006.
http://www.regal-beloit.com/gedraft.html, "Welcome to GE Commercial Motors by Regal-Beloit," 1 page, printed Apr. 26, 2006.
Lennox, "G61MPV Series Units," Installation Instructions, 2 pages, Oct. 2006.

* cited by examiner

NEGATIVE PRESSURE CONDITIONING DEVICE WITH LOW PRESSURE CUT-OFF

RELATED APPLICATION

This application is a Continuation-In-Part (CIP) of U.S. patent application Ser. No. 11/164,083 filed Nov. 9, 2005, entitled NEGATIVE PRESSURE SIGNAL CONDITIONING DEVICE AND FORCED AIR FURNACE EMPLOYING SAME. Said application is hereby incorporated by reference in its entirety.

TECHNICAL FIELD

The present invention pertains generally to HVAC systems and more particularly to furnaces such as forced-air furnaces relying upon a pneumatic signal to control a gas valve.

BACKGROUND

Many homes rely upon forced-air furnaces to provide heat during cool and/or cold weather. Typically, a forced-air furnace employs a burner that burns a fuel such as natural gas, propane or the like, and provides heated combustion gases to the interior of a heat exchanger. A circulating blower forces return air from the house over or through the heat exchanger, thereby heating the air. The combustion gases proceed through the heat exchanger to a collector box, and are then exhausted. In some cases, a combustion gas blower pulls the combustion gases through the heat exchanger and the collector box. The heated air is subsequently routed throughout the house via a duct system. A return duct system returns air to the furnace to be re-heated.

A gas valve controls how much fuel is provided to the burner. In some instances, a pressure drop across the heat exchanger, i.e., between the burner and the collector box, may be used as a signal to the gas valve to regulate gas flow to the burner, as this pressure drop is known to be at least roughly proportional to the combustion gas flow through the heat exchanger. However, this pressure signal is subject to transient spikes resulting from the combustion gas blower cycling on and off, system harmonics, and the like. Thus, a need remains for improved devices and methods of controlling furnaces such as forced-air furnaces.

SUMMARY

The present invention pertains to improved devices and method of controlling furnaces such as forced-air furnaces. In some instances, a conditioned pneumatic signal may be used as an input signal to a gas valve in aiding operation of the furnace.

Accordingly, an illustrative but non-limiting example of the present invention may be found in a pneumatic signal conditioning device that includes a first fluid path and a second fluid path. The first fluid path may include a first inlet and a first outlet and may, if desired, be configured such that the first outlet provides a first conditioned signal that represents a pressure at the first inlet. The second fluid path may include a second inlet and a second outlet and may, if desired, be configured such that the second outlet provides a second conditioned signal that represents a pressure at the second inlet. A pressure switch may be disposed in fluid communication with the first fluid path and the second fluid path such that the first fluid path extends through a first side of the pressure switch while the second fluid path extends through a second side of the pressure switch.

In some cases, the pressure switch may provide a signal such as an electrical signal that stops gas flow through a gas valve if the pressure difference between the first outlet and the second outlet drops below a predetermined threshold. In some instances, the pressure switch may include a pressure switch housing that defines an air volume that further conditions one of the first conditioned signal and/or the second conditioned signal.

Another illustrative but non-limiting example of the present invention may be found in a gas valve assembly that includes a gas valve that is configured to provide gas to a fuel burning appliance and that includes a first port and a second port. A signal conditioning device may include a first fluid path having a first inlet and a first outlet as well as a second fluid path having a second inlet and a second outlet. A pressure switch may have a first pressure switch inlet, a first pressure switch outlet, a second pressure switch inlet and a second pressure switch outlet. In some cases, the first outlet may be in fluid communication with the first pressure switch inlet, the second outlet may be in fluid communication with the second pressure switch inlet, the first pressure switch outlet may be in fluid communication with the first port and the second pressure switch outlet may be in fluid communication with the second port, although this is not required.

Another illustrative but non-limiting example of the present invention may be found in a forced-furnace having a heat exchanger, a burner that is configured to burn fuel and provide combustion products to the heat exchanger, and a gas valve that is configured to provide fuel to the burner. A pneumatic signal conditioning device including a pressure switch may have a first inlet that may be in fluid communication with an upstream heat exchanger port and a second inlet that may be in fluid communication with a downstream heat exchanger port. The pneumatic signal conditioning device may have a first outlet that may be in fluid communication with a first gas valve pressure port and a second outlet that may be in fluid communication with a second gas valve pressure port.

The above summary of the present invention is not intended to describe each disclosed embodiment or every implementation of the present invention. The Figures, Detailed Description and Examples which follow more particularly exemplify these embodiments.

BRIEF DESCRIPTION OF THE FIGURES

The invention may be more completely understood in consideration of the following detailed description of various embodiments of the invention in connection with the accompanying drawings, in which.

Figure 1:
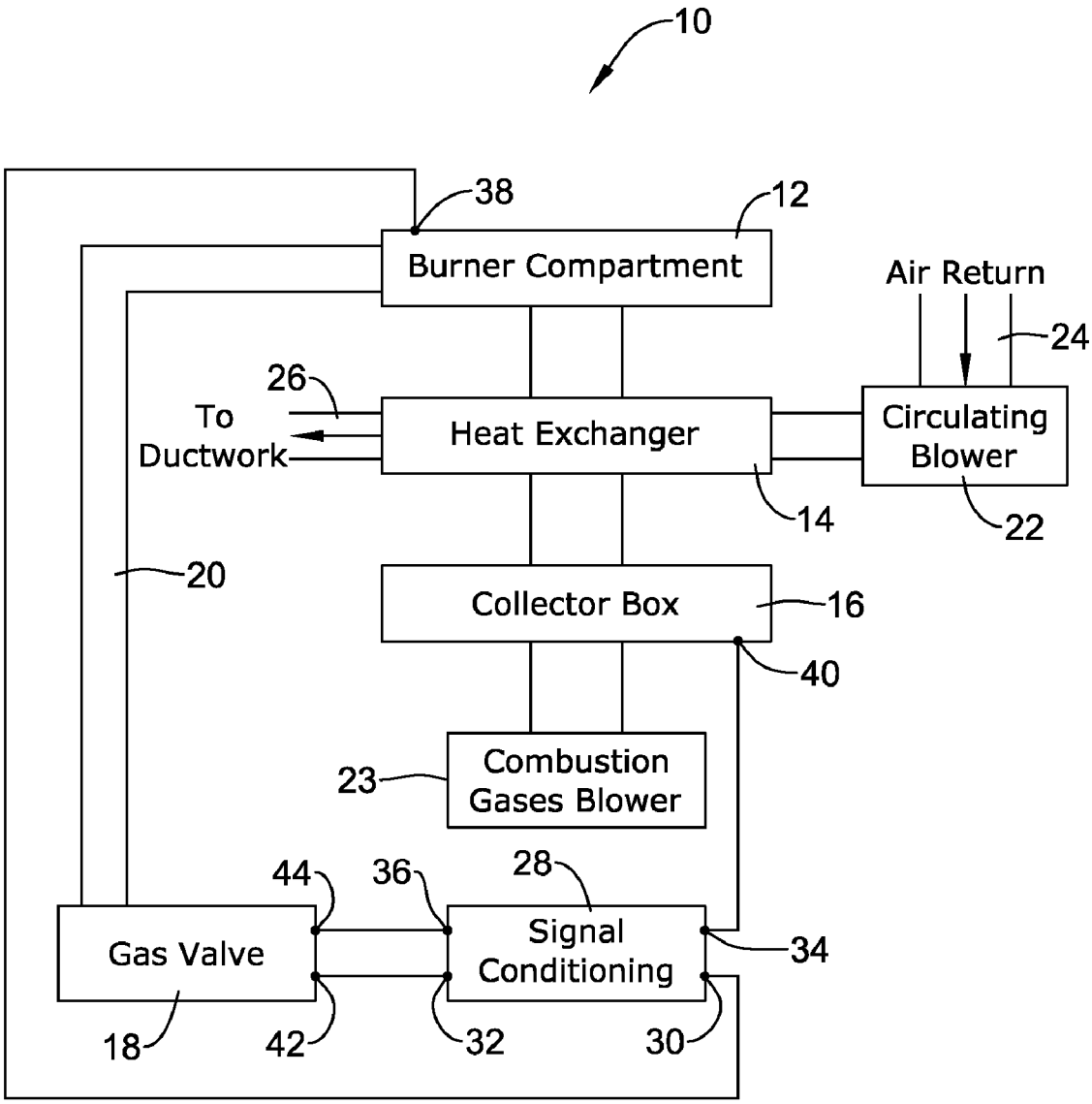
FIG. 1 is a diagrammatic illustration of a forced-air furnace in accordance with an embodiment of the present invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION

The following description should be read with reference to the drawings, in which like elements in different drawings are numbered in like fashion. The drawings, which are not necessarily to scale, depict selected embodiments and are not intended to limit the scope of the invention. Although examples of construction, dimensions, and materials are illustrated for the various elements, those skilled in the art will recognize that many of the examples provided have suitable alternatives that may be utilized.

FIG. 1 is a highly diagrammatic illustration of a forced-air furnace 10, which may include additional components not described herein. The primary components of furnace 10 include a burner compartment 12, a heat exchanger 14 and a collector box 16. A gas valve 18 provides fuel such as natural gas or propane, from a source (not illustrated) to burner compartment 12 via a gas line 20. Burner compartment 12 burns the fuel provided by gas valve 18, and provides heated combustion products to heat exchanger 14. The heated combustion products pass through heat exchanger 14 and exit into collector box 16, which ultimately exhausts (not illustrated) to the exterior of the building or home in which furnace 10 is installed.

A circulating blower 22 accepts return air from the building or home's return ductwork 24 and blows the return air through heat exchanger 14, thereby heating the air. The heated air then exits heat exchanger 14 and enters the building or home's conditioned air ductwork 26. For enhanced thermal transfer and efficiency, the heated combustion products may pass through heat exchanger 14 in a first direction while circulating blower 22 forces air through heat exchanger 14 in a second, opposite direction. In some cases, as illustrated, a combustion gas blower 23 may be positioned downstream of collector box 16 and may pull combustion gases through heat exchanger 14 and collector box 16. In some instances, for example, the heated combustion products may pass downwardly through heat exchanger 14 while the air blown through by circulating blower 22 may pass upwardly through heat exchanger 14, but this is not required.

As noted, gas valve 18 provides fuel, via fuel line 20, to burner compartment 12. Gas valve 18 may, in some instances, rely at least partially on a measurement of the pressure drop through heat exchanger 14 in order to regulate gas flow to burner compartment 12. In order to provide an improved, conditioned, signal to gas valve 18, furnace 10 may include a signal conditioning device 28. The internal structure of an illustrative signal conditioning device 28 is more fully described in subsequent Figures.

The illustrative signal conditioning device 28 includes a first inlet 30 and a first outlet 32, and a second inlet 34 and a second outlet 36. First inlet 30 is in fluid communication with a burner compartment pressure port 38 while second inlet 34 is in fluid communication with a collector box pressure port 40. First outlet 32 is in fluid communication with a first pressure port 42 present on gas valve 18 while second outlet 36 is in fluid communication with a second pressure port 44 present on gas valve 18. It can be seen that a pneumatic signal at first inlet 30 represents a pressure at burner compartment 12, i.e., at the top or inlet of heat exchanger 14 while a pneumatic signal at second inlet 34 represents a pressure at collector box 16, i.e, at the bottom or outlet of heat exchanger 14. Thus, the difference therebetween provides an indication of the pressure drop across heat exchanger 14.

However, as noted previously, this pressure signal may be subject to various transient interruptions. Consequently, signal conditioning device 28 is configured to provide a conditioned (e.g. damped) pneumatic signal from first outlet 32 and/or second outlet 36. As a result, gas valve 18 may be provided with a stable pneumatic signal across first pressure port 42 and second pressure port 44. Signal conditioning device 28 may take several different forms, as outlined in subsequent Figures. Signal conditioning device 28 may be formed of any suitable polymeric, metallic or other material, as desired. In some instances, signal conditioning device 28 may be molded as an integral unit. In other cases, signal conditioning device 28 may be formed by joining tubular sections together using any suitable technique such as adhesives, thermal welding, sonic welding and the like.

Figure 2:
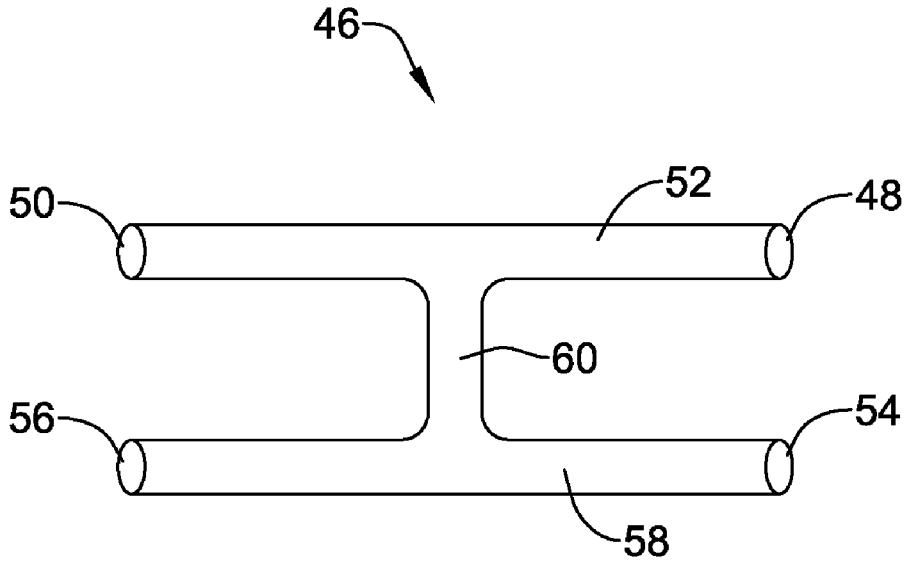
FIG. 2 is a view of a pneumatic signal conditioning device in accordance with an embodiment of the invention.
Figure 3:
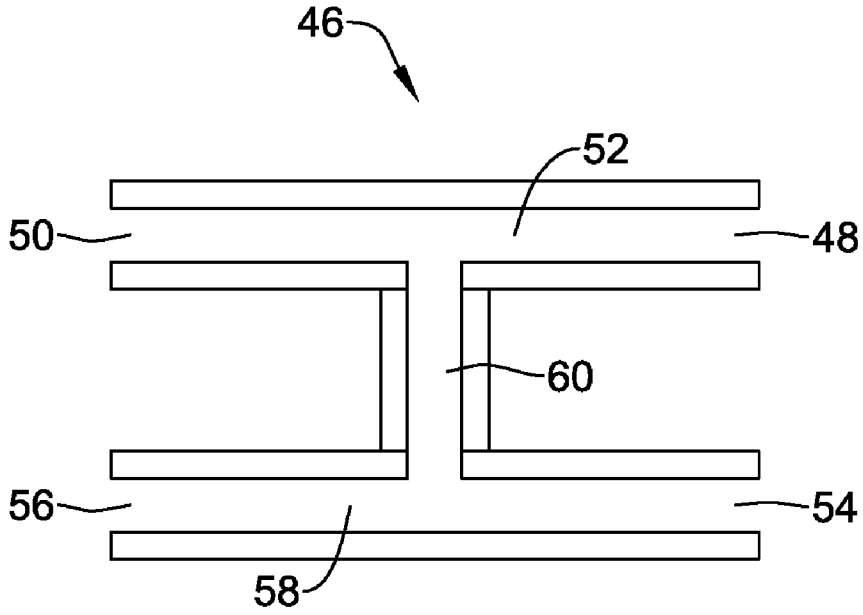
FIG. 3 is a cross-section of FIG. 2.

FIGS. 2 and 3 show an illustrative signal conditioning device 46 in accordance with the present invention. FIG. 2 is an exterior view while FIG. 3 is a cross-section, better illustrating the fluid paths extending through signal conditioning device 46. Signal conditioning device 46 has a first inlet 48, a first outlet 50 and a first fluid path 52 extending from first inlet 48 to first outlet 50. Similarly, signal conditioning device 46 includes a second inlet 54, a second outlet 56, and a second fluid path 58 that extends from second inlet 54 to second outlet 56. In the illustrative embodiment, a third fluid path 60 extends from first fluid path 52 to second fluid path 58.

In the illustrative embodiment, first fluid path 52, second fluid path 58 and third fluid path 60 of signal conditioning device 46 are diagrammatically shown as being approximately the same size. It should be recognized that while each of first fluid path 52, second fluid path 58 and third fluid path 60 may have similar or even identical dimensions, this is not required.

In a particular embodiment, for example, signal conditioning device 46 may have an overall length of about 1.375 inches, an overall width of about 1.63 inches and an overall thickness of about 0.46 inches. First inlet 48 and second inlet 54 may each have an internal diameter of about 0.26 inches. First outlet 50 and second outlet 56 may each have an internal diameter of about 0.325 inches. These inlet and outlet dimensions may be altered by inclusion of appropriately sized conditioning orifices, as will be more fully discussed with respect to subsequent Figures. It will be recognized that these dimensions may also be varied to accommodate various combinations of particular gas valves and particular furnaces.

Figure 4:
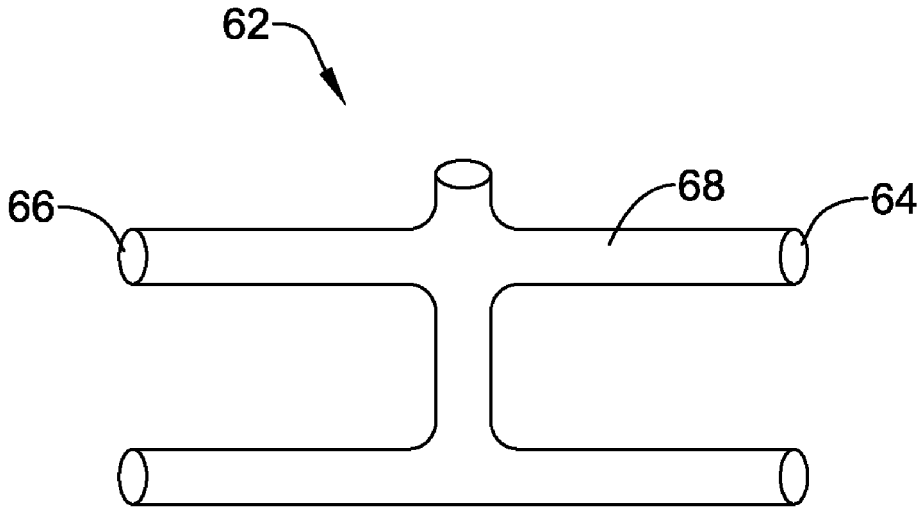
FIG. 4 is a view of a pneumatic signal conditioning device in accordance with an embodiment of the invention.
Figure 5:
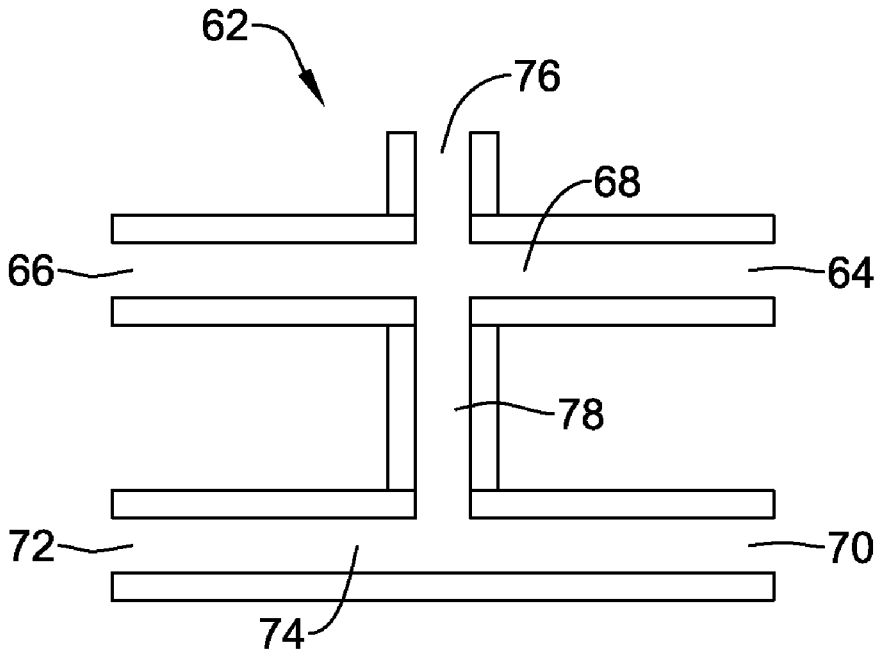
FIG. 5 is a cross-section of FIG. 4.

FIGS. 4 and 5 show another illustrative signal conditioning device 62 in accordance with the present invention. FIG. 4 is an exterior view while FIG. 5 is a cross-section, better illustrating the fluid paths extending through signal conditioning device 62. Signal conditioning device 62 has a first inlet 64, a first outlet 66 and a first fluid path 68 extending from first inlet 64 to first outlet 66. Similarly, signal conditioning device 62 includes a second inlet 70, a second outlet 72 and a second fluid path 74 that extends from second inlet 70 to second outlet 72. Signal conditioning device 62 also includes a reference port 76 that is in fluid communication with at least first fluid path 68. A third fluid path 78 extends from first fluid path 68 to second fluid path 74, and provides fluid communication therebetween.

Figure 6:
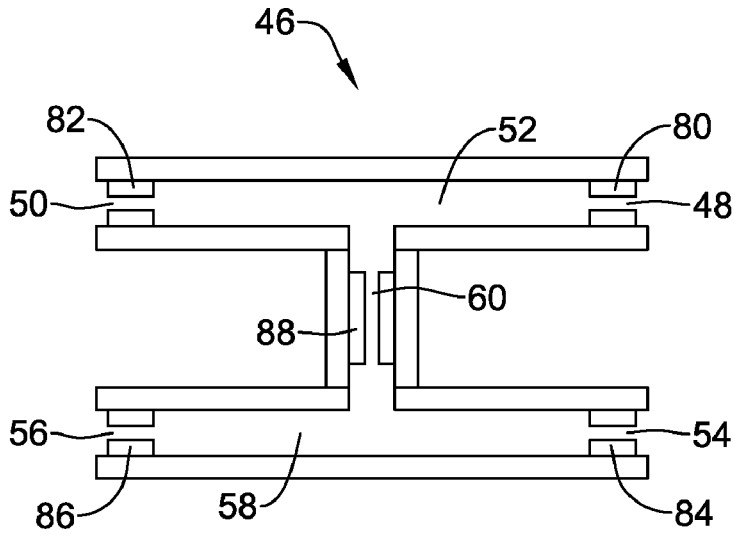
FIG. 6 is a cross-sectional view of the pneumatic signal conditioning device of FIG. 2, including conditioning orifices.

FIG. 6 is a cross-section akin to the embodiment shown in FIGS. 2 and 3, but includes conditioning orifices. FIG. 6 shows signal conditioning device 46 as it might be tuned for a particular application. By varying the internal dimensions of each of the conditioning orifices, it has been determined that a conditioned signal, in which transients have been damped, may be provided.

It can be seen that first inlet 48 includes a first inlet conditioning orifice 80 while first outlet 50 includes a first outlet conditioning orifice 82. Similarly, second inlet 54 includes a second inlet conditioning orifice 84 and second outlet 56 includes a second outlet conditioning orifice 86. Third fluid path 60 includes a bleed orifice 88. In some instances, first inlet conditioning orifice 80 and second inlet conditioning orifice 84 may be referred to, respectively, as a burner manifold conditioning orifice and as a collector box conditioning orifice.

In some instances, pneumatic signal conditioning device 46 may be constructed in a way to facilitate placement of bleed orifice 88 within third fluid path 60. In some cases, the tubing or other structure forming first fluid path 52 may, for example, include a removable plug or other structure that provides access to third fluid path 60 yet can be inserted to retain the fluid properties of first fluid path 52.

In some cases, pneumatic signal conditioning device 46 may be constructed by combining a first tee, a second tee and a short length of tubing. For example, a first tee may form first fluid path 52 while a second tee may form second fluid path 58. Third fluid path 60 may be formed by extending a short length of tubing between the first and second tees. It will be recognized that such a structure would provide ready access to an interior of third fluid path 60 for placing and/or replacing bleed orifice 88.

Figure 7:
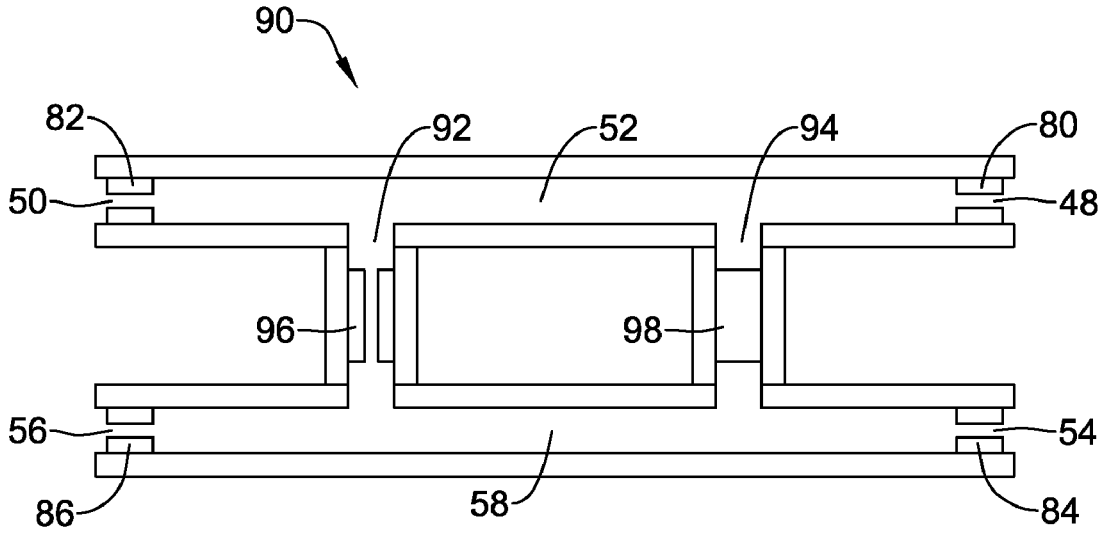
FIG. 7 is a cross-sectional view of a pneumatic signal conditioning device in accordance with an embodiment of the invention.

FIG. 7 is a cross-section view of a pneumatic signal conditioning device 90 including several conditioning orifices. By varying the internal dimensions of each of the conditioning orifices, it has been determined that a conditioned signal, in which transients have been damped, may be provided.

It can be seen that first inlet 48 includes a first inlet conditioning orifice 80 while first outlet 50 includes a first outlet conditioning orifice 82. Similarly, second inlet 54 includes a second inlet conditioning orifice 84 and second outlet 56 includes a second outlet conditioning orifice 86. Unlike FIG. 6, however, pneumatic signal conditioning device 90 includes both a third fluid path 92 and a fourth fluid path 94. In some cases, fourth fluid path 94 may be at least substantially parallel to third fluid path 92, but this is not required.

Third fluid path 92 may include a fixed bleed orifice 96 and fourth fluid path 94 may include an adjustable orifice 98. Adjustable orifice 98 may be any structure that provides an opportunity for adjusting airflow permitted through adjustable orifice 98. In some cases, for example, adjustable orifice 98 may be adjustable via a set screw or other similar structure. In some cases, fixed bleed orifice 96 may provide a fixed minimum bleed while adjustable orifice 98 may be adjusted in order to modify or fine tune the relative amount of bleeding that occurs through pneumatic signal conditioning device 90. In some instances, first inlet conditioning orifice 80 and second inlet conditioning orifice 84 may be referred to, respectively, as a burner manifold conditioning orifice and as a collector box conditioning orifice. As discussed with respect to FIG. 6, pneumatic signal conditioning device 90 may be constructed in a way to facilitate placement of fixed bleed orifice 96 and adjustable orifice 98.

Figure 8:
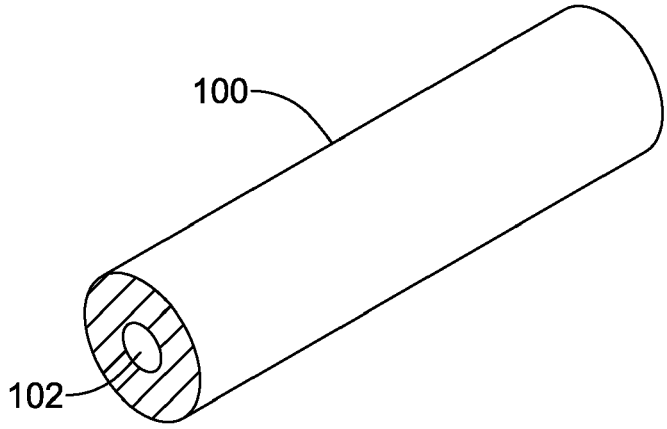
FIG. 8 is a perspective view of a conditioning orifice in accordance with an embodiment of the invention.
Figure 9:
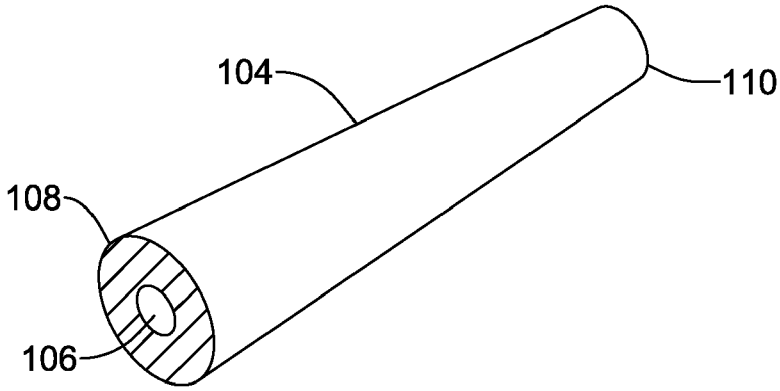
FIG. 9 is a perspective view of a conditioning orifice in accordance with an embodiment of the invention.
Figure 10:
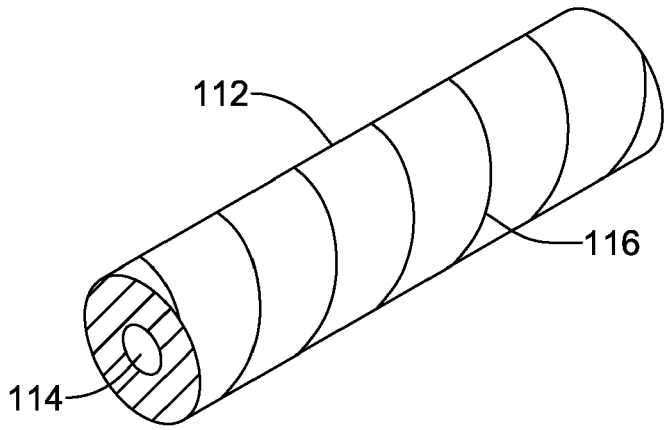
FIG. 10 is a perspective view of a conditioning orifice in accordance with an embodiment of the invention.

FIGS. 8, 9 and 10 show illustrative embodiments for these conditioning orifices. FIG. 8 shows a cylindrical conditioning orifice 100 including an aperture 102 extending therethrough. In some instances, signal conditioning device 46 (and the others described herein) may be tuned by varying the relative size of aperture 102 in one or more of the conditioning apertures used. Aperture 102 may vary in size along the length of the cylindrical conditioning orifice 100, or aperture 102 may have a constant diameter. In a particular instance, aperture 102 may have a constant diameter of about 0.146 inches, although this dimension may changed to accommodate various combinations of particular gas valves and particular furnaces.

Cylindrical conditioning orifice 100 may be secured within the appropriate inlet or outlet using any suitable technique, such as a compression fit, adhesives, solder, or the like. Alternatively, cylindrical conditioning orifice 100 may be integrally molded within the appropriate inlet or outlet.

FIG. 9 shows a tapered conditioning orifice 104 having an aperture 106 extending from an outer end 108 to an inner end 110. In some instances, signal conditioning device 46 may be tuned by varying the relative size of aperture 106 in one or more of the conditioning apertures used. Aperture 106 may vary in diameter along the length of the tapered conditioning orifice 104, or aperture 106 may have a constant diameter. In a particular instance, aperture 106 may have a constant diameter of about 0.146 inches, although this dimension may changed to accommodate various combinations of particular gas valves and particular furnaces.

Tapered conditioning orifice 104 may be secured within the appropriate inlet or outlet using any suitable technique, such as a compression fit, adhesives, solder, or the like. Alternatively, tapered conditioning orifice 104 may be integrally molded within the appropriate inlet or outlet.

FIG. 10 shows a cylindrical conditioning aperture 112 having an aperture 114 extending therethrough. In some instances, signal conditioning device 46 may be tuned by varying the relative size of aperture 114 in one or more of the conditioning apertures used. Aperture 114 may vary in diameter along the length of the cylindrical conditioning orifice 112, or aperture 114 may have a constant diameter. In a particular instance, aperture 114 may have a diameter of about 0.146 inches, although this dimension may changed to accommodate various combinations of particular gas valves and particular furnaces.

Cylindrical conditioning orifice 112 includes threads 116 on an exterior surface thereof, and thus may be screwed into the appropriate inlet or outlet, if desired. In the embodiments discussed above, it has been considered that the apertures extending the length of the conditioning orifices have constant or perhaps tapering diameters. It is contemplated, however, that these apertures may well have a more complicated geometry. For example, an aperture through a conditioning orifice may have a diameter that changes one or more times, in a step-wise manner.

Figure 11:
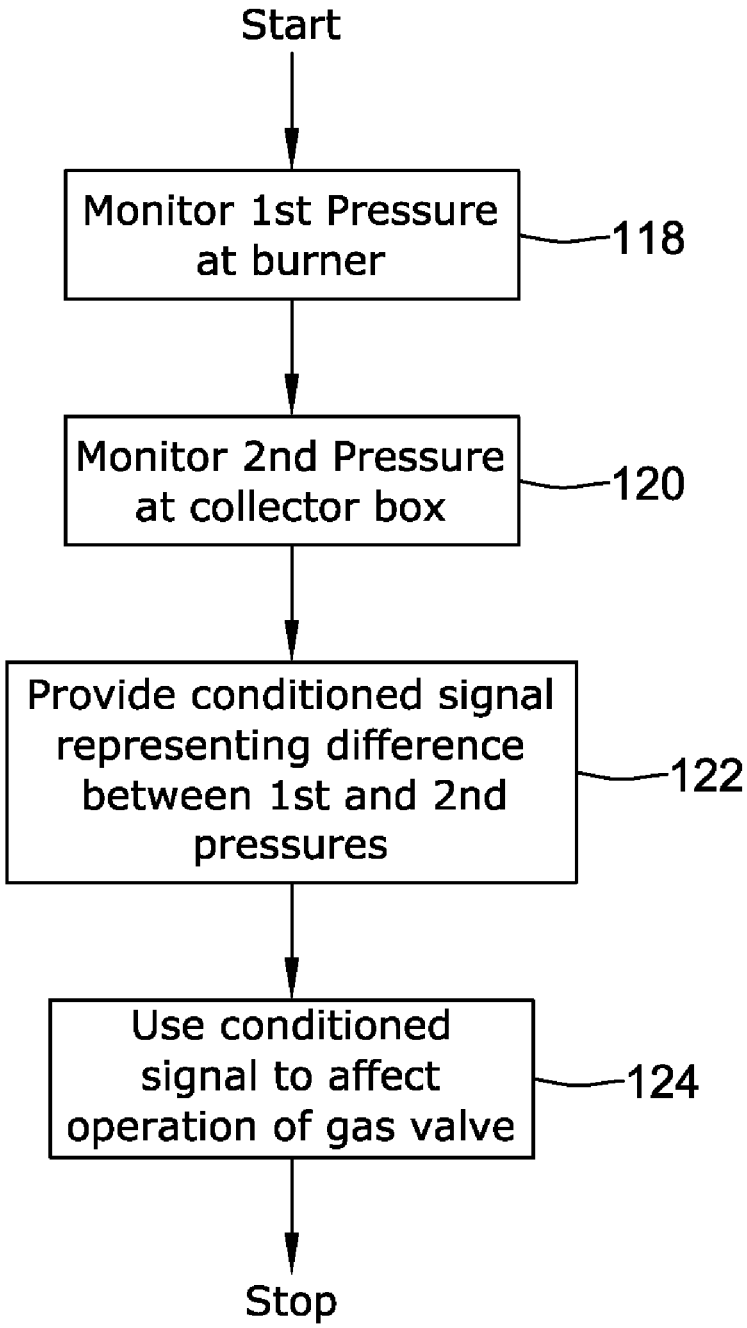
FIG. 11 is a flow diagram showing an illustrative but non-limiting method of operating the forced-air furnace of FIG. 1 in accordance with an embodiment of the invention.

FIG. 11 shows an illustrative but non-limiting method of operating the forced-air furnace of FIG. 1 in accordance with an embodiment of the invention. At block 118, a first pressure is monitored at the burner compartment 12 (FIG. 1). As discussed herein, this may represent a pressure at the entrance to heat exchanger 14 (FIG. 1). At block 120, a second pressure is monitored at the collector box 16 (FIG. 1). As discussed herein, this may represent a pressure at the exit from heat exchanger 14. Control passes to block 122, wherein a conditioned signal is provided that represents a difference between the first and second pressures. The conditioned signal may, for example, be a pneumatic signal that is provided as a pressure difference between first outlet 32 and second outlet 36 of signal conditioner 28 (FIG. 1). This signal may be transmitted to first pressure port 42 (FIG. 1) and second pressure port 44 (FIG. 1) of gas valve 18 (FIG. 1). At block 124, the conditioned signal is used to affect the operation of gas valve 18.

Figure 12:
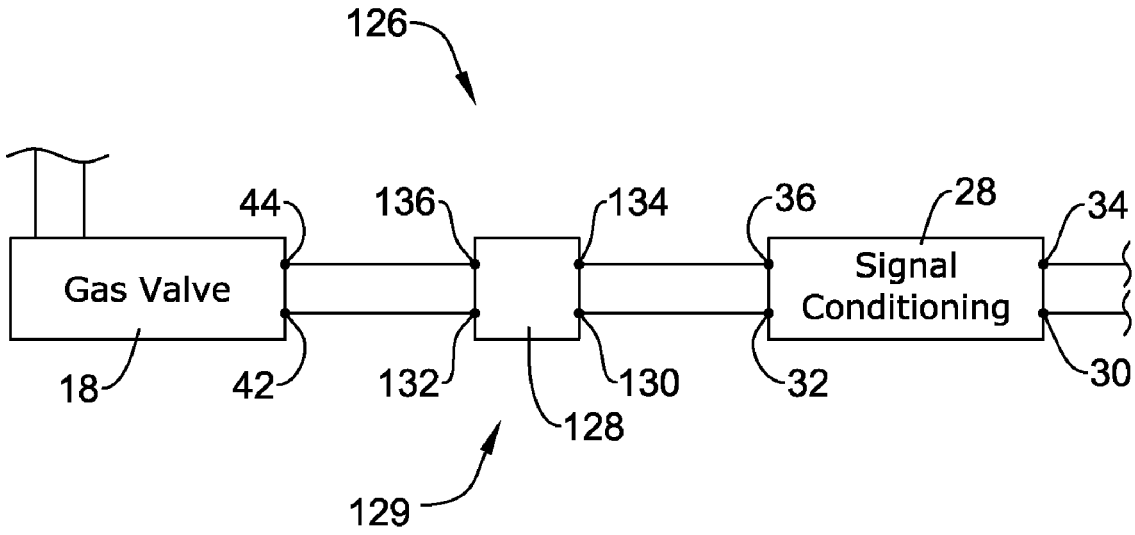
FIG. 12 is a diagrammatic illustration of a gas valve assembly in accordance with an embodiment of the present invention.

FIG. 12 shows an illustrative gas valve assembly 126 that may be in conjunction with a fuel burning appliance such as forced-air furnace 10 (FIG. 1). Gas valve assembly 126 includes a gas valve 18 (FIG. 1) as well as signal conditioning device 28 (FIG. 1). In some cases, gas valve 18 may be an amplified gas/air control, but this is not required. Gas valve assembly 126 also includes a pressure switch 128. In some instances, pressure switch 128 may be considered as a separate add-on to signal conditioning device 28, or may be formed as part of signal conditioning device 28.

Pressure switch 128 may include a first pressure switch inlet 130 and a first pressure switch outlet 132. Similarly, pressure switch 128 may include a second pressure switch inlet 134 and a second pressure switch outlet 136. A first fluid path may extend through signal conditioning device 28 from first inlet 30 to first outlet 32. First outlet 32 may be in fluid communication with first pressure switch inlet 130. A second fluid path may extend through signal conditioning device 28 from second inlet 34 to second outlet 36. Second outlet 36 may be in fluid communication with second pressure switch inlet 132. In some cases, first pressure switch outlet 132 may then, in turn, be in fluid communication with first pressure port 42 while second pressure switch outlet 136 may be in fluid communication with second pressure port 44.

In some cases, pressure switch 128 and signal conditioning device 28 may, in combination, be considered as being a signal conditioning device 129. Signal conditioning device 28 may, as discussed above, include a first fluid path that encompasses first inlet 30 and first outlet 32. In some cases, the first fluid path may extend through a first side of pressure switch 128 while the second fluid path may extend through a second side of pressure switch 128.

In some cases, first inlet 30 of signal conditioning device 28 may be in fluid communication with a relatively clean fluid source while second inlet 34 may be in fluid communication with a relatively dirty fluid source. This may happen, for example, if first inlet 30 is in fluid communication with a burner compartment pressure source while second inlet 34 is in fluid communication with a collector box pressure switch. Thus, in some cases it may be beneficial for the first fluid path to extend through a switch side of the diaphragm disposed within pressure switch 128 and for the second fluid path to extend through a second side of pressure switch 128, such as along a mounting pan side of the diaphragm disposed within pressure switch 128. In some instances, this routing may help protect electronics disposed on the switch side of the diaphragm, when so provided.

It will be recognized that pressure switch 128, shown schematically in FIG. 12, may include a pressure switch housing that may define an air volume. This air volume may further condition at least one of a first conditioned signal that is representative of a pressure at first inlet 30, for example, and/or a second conditioned signal that is representative of a pressure at second inlet 34.

As discussed above, the pressure drop across heat exchanger 14 (FIG. 1) may be used as a signal to regulate gas flow through gas valve 18 and hence to burner compartment 12 (FIG. 1). In some instances, if this pressure drop becomes too small, this may indicate a condition in which operation of burner compartment 12 may be undesirable. In some cases, pressure switch 128 may be configured to provide an electrical, pneumatic, optical, magnetic or any other suitable signal to gas valve 18 to indicate when a small pressure drop has been detected, and thus stop gas flow through gas valve 18.

In some cases, pressure switch 128 may be configured to provide such a signal when, for example, a difference between the first conditioned signal and the second conditioned signal drops below a predetermined level and, in some cases, for at least a predetermined length of time. In some instances, it is contemplated that pressure switch 128 may, in effect, ignore a minimal pressure drop that only occurs for a short period of time. In some cases, a minimal pressure drop, regardless of duration, may trigger pressure switch 128 to provide a signal for gas valve 18.

In some instances, the first conditioned signal may be a negative pressure signal measured upstream of heat exchanger 14 (FIG. 1) and may have a magnitude of about 0.2 to about 0.25 inches water (about 0.05 to about 0.06 kPa). In some cases, the second conditioned signal may be a negative pressure signal measured downstream of heat exchanger 14 and may have a magnitude of about 2.5 inches water (about 0.6 kPa).

In some cases, the pressure switch 128 may be configured to produce such a signal when this pressure difference drops to the range of about 0.2 to about 0.3 inches water (about 0.05 to about 0.07 kPa). If desired, the pressure switch 128 may be configured to stop gas flow through gas valve 18 at a pressure difference of about 0.3 inches water (about 0.07 kPa).

In some instances, pressure switch 128 may provide an electrical or other suitable signal to gas valve 18. In some cases, gas valve 18 and pressure switch 128 may be electrically wired in series to help ensure that gas flow through gas valve 18 is stopped when pressure switch 128 detects a potentially less than optimal operating condition. In some cases, pressure switch 128 may, for example, provide a signal to gas valve 18 by providing operating power to gas valve 18, and pressure switch 128 may act as an interlock. If a potentially unsafe operating condition is detected, pressure switch 128 may send a signal to gas valve 18 by terminating electrical power to gas valve 18 or to a control input of gas valve 18.

If desired, pressure switch 128 may be configured to instead provide an electrical signal to a controller that in turn provides appropriate instructions to gas valve 18. It will be recognized that pressure switch 128 may be configured to provide an analog signal that is proportional or at least representative of the detected pressure difference. In some cases, pressure switch 128 may be provided to provide a binary or digital signal, i.e., a yes or no to a controller.

In some cases, pressure switch 128 may include one or more pressure sensors that are in fluid communication with the first and second conditioned signals and that are electrically connected, either directly or through a controller or the like, to gas valve 18 such that an electrical signal or message may be sent if a particular pressure drop is detected.

Figure 13:
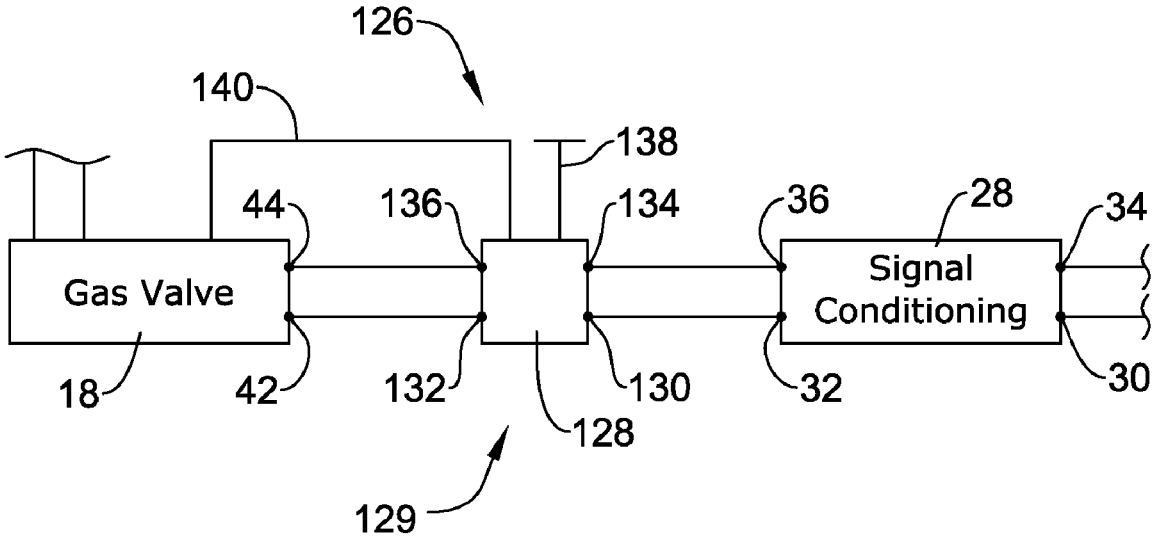
FIG. 13 is a diagrammatic illustration of a gas valve assembly in accordance with an embodiment of the present invention.

FIG. 13 illustrates a particular instance in which pressure switch 128 is electrically wired in series with gas valve 18. Pressure switch 128 may receive power from a power source 138, which may be adapted to provide power at any suitable voltage. In some cases, power source 138 may provide a voltage of about 24 volts, as many furnaces, thermostats and the like operate at this level. Pressure switch 128 may then pass power to gas valve 18 through electrical line 140. It will be recognized that electrical line 140 may represent one, two, or more distinct electrical lines, as desired.

In this configuration, pressure switch 128 may be considered as providing electrical power, i.e., an electrical signal, to permit operation of gas valve 18 as along as a pressure difference detected by pressure switch 128 is sufficiently high. If the pressure difference detected by pressure switch 128 falls below a threshold limit, pressure switch 128 may switch to an open position, which may terminate electrical power to gas valve 18 and gas valve 18 may stop operation.

Figure 14:
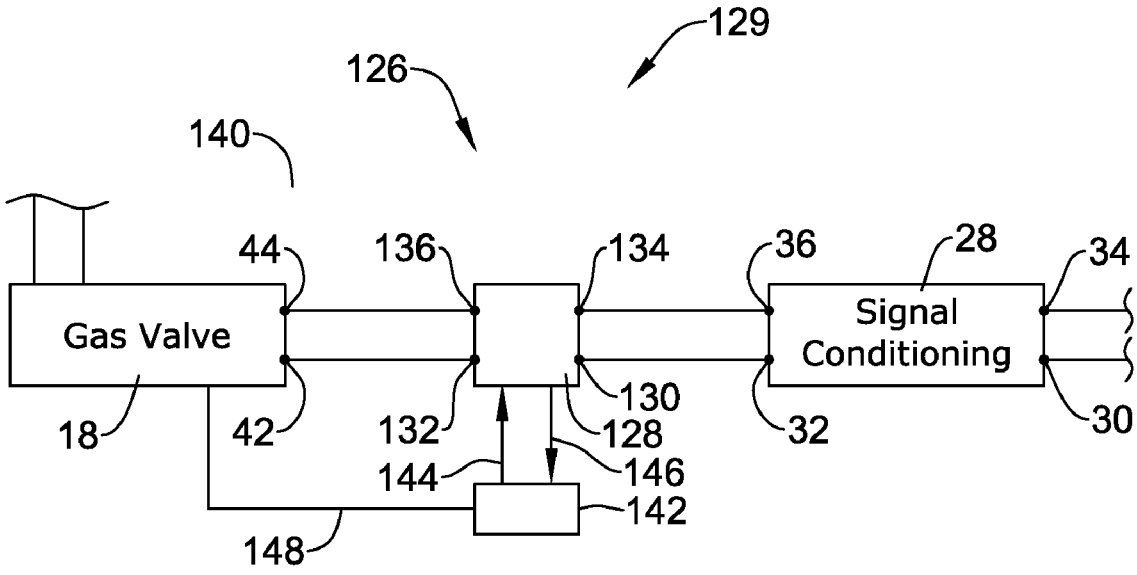
FIG. 14 is a diagrammatic illustration of a gas valve assembly in accordance with an embodiment of the present invention.

FIG. 14 shows a particular configuration in which pressure switch 128 is connected to gas valve 18 through a controller 142. In some cases, controller 142 may include a power line 144 that provides operating power to pressure switch 128, but this is not required. In some instances, an electrical or other signal line 146 may return an electrical or other signal to controller 142 that is, for example, representative of a pressure difference detected by pressure switch 128. Controller 142 may provide a control signal to gas valve 18 via line 148. In some cases, line 148 may represent two or more distinct signal lines and/or may represent a power line that selectively provides power to gas valve 18.

In some cases, pressure switch 128 may output a digital signal to controller 142. Controller 142 may then determine how to control gas valve 18 based on the signal from pressure switch 128. In some instances, pressure switch 128 may instead output an analog signal to controller 142, and controller 142 may then be adapted to determine, based on the analog signal, how to control gas valve 18.

The invention should not be considered limited to the particular examples described above, but rather should be understood to cover all aspects of the invention as set out in the attached claims. Various modifications, equivalent processes, as well as numerous structures to which the invention can be applicable will be readily apparent to those of skill in the art upon review of the instant specification.

I claim:

1. A gas valve assembly comprising:

a gas valve configured to provide gas to a fuel burning appliance, the gas valve comprising a first port and a second port;

a signal conditioning device comprising a first fluid path including a first inlet and a first outlet and a second fluid path including a second inlet and a second outlet; and a pressure switch having a first pressure switch inlet, a first pressure switch outlet, a second pressure switch inlet and a second pressure switch outlet;

wherein the first outlet is in fluid communication with the first pressure switch inlet, the second outlet is in fluid communication with the second pressure switch inlet, the first pressure switch outlet is in fluid communication with the first port of the gas valve and the second pressure switch outlet is in fluid communication with the second port of the gas valve.

2. The gas valve assembly of claim 1, wherein the first fluid path is configured such that the first outlet provides a first conditioned signal representing a pressure at the first inlet.

3. The gas valve assembly of claim 2, wherein the second fluid path is configured such that the second outlet provides a second conditioned signal representing a pressure at the second inlet.

4. The gas valve assembly of claim 2, wherein the first pressure switch outlet provides a pneumatic signal proportional to a pressure at the first outlet.

5. The gas valve assembly of claim 4, wherein the second pressure switch outlet provides a pneumatic signal proportional to a pressure at the second outlet.

6. The gas valve assembly of claim 4, wherein the pressure switch provides a signal to the gas valve, thereby stopping gas flow, if a difference between the pressure at the first outlet and the pressure at the second outlet indicates that it may not be safe to operate the fuel burning appliance.

7. The gas valve assembly of claim 4, wherein the pressure switch stops electrical power to the gas valve if a difference between the pressure at the first outlet and the pressure at the second outlet indicates that it may not be safe to operate the fuel burning appliance.

8. A forced-air furnace comprising:

a heat exchanger having an upstream port and a downstream port;

a burner configured to burn fuel and provide combustion products to the heat exchanger;

a gas valve configured to provide fuel to the burner, the gas valve comprising a first pressure port and a second pressure port; and a pneumatic signal conditioning device comprising:

a first fluid path comprising a first inlet and a first outlet, the first fluid path configured such that the first outlet provides a first conditioned signal representing a pressure at the first inlet;

a second fluid path comprising a second inlet and a second outlet, the second fluid path configured such that the second outlet provides a second conditioned signal representing a pressure at the second inlet; and a pressure switch disposed in fluid communication with the first fluid path and the second fluid path such that the first fluid path extends through a first side of the pressure switch and the second fluid path extends through a second side of the pressure switch;

wherein the first inlet is in fluid communication with the upstream port, the second inlet is in fluid communication with the downstream port, the first outlet is in fluid communication with the first pressure port and the second outlet is in fluid communication with the second pressure port.

9. The forced-air furnace of claim 8, wherein the upstream port is proximate the burner.

10. The forced-air furnace of claim 8, further comprising a collector box positioned proximate the downstream port.

11. The forced-air furnace of claim 8, further comprising a circulating blower adapted to blow air across an exterior of the heat exchanger.

12. The forced-air furnace of claim 8, further comprising a combustion gas blower adapted to pull combustion gases through an interior of the heat exchanger.

13. The forced-air furnace of claim 8, wherein the pneumatic signal conditioning device is adapted to dampen transient spikes.

14. The forced-air furnace of claim 8, wherein the pneumatic signal conditioning device is adapted to stop gas flow through the gas valve if a pressure drop across the heat exchanger is less than about 0.3 inches water (0.07 kPa).

15. A pneumatic signal conditioning device for providing conditioned pneumatic control signals to a pneumatically controlled gas valve comprising:

a housing having a first inlet, a second inlet, a first outlet and a second outlet;

the housing defining a first fluid path that extends between the first inlet and the first outlet;

the housing further defining a second fluid path that extends between the second inlet and the second outlet;

the housing further defining a third fluid path that extends between the first fluid path and the second fluid path;

the first fluid path, the second fluid path and the third fluid path having dimensions that produce a first conditioned signal at the first outlet representing a pressure at the first inlet and a second conditioned signal at the second outlet representing a pressure at the second inlet;

a pressure switch having a first pressure switch inlet, a second pressure switch inlet, a first pressure switch outlet and a second pressure switch outlet, wherein the first pressure switch inlet is in fluid communication with the first pressure switch outlet and the second pressure switch inlet is in fluid communication with the second pressure switch outlet;

the first pressure switch inlet being in fluid communication with the first outlet of the housing and the second pressure switch inlet being in fluid communication with the second outlet of the housing;

wherein the first pressure switch outlet and the second pressure switch outlet are configured to provide conditioned pneumatic control signals to a pneumatically controlled gas valve; and wherein the pressure switch is configured to provide a control signal that can disable a pneumatically controlled gas valve when a minimum pressure differential is detected between a pressure related to the pressure at the first pressure switch inlet of the pressure switch and a pressure related to the pressure at the second pressure switch inlet of the pressure switch.

16. A gas valve assembly comprising:

a modulating gas valve configured to provide gas to a fuel burning appliance, the gas valve comprising a first control port and a second control port;

a signal conditioning device having a first fluid path including a first inlet and a first outlet and a second fluid path including a second inlet and a second outlet;

a pressure switch electrically wired in series between a power source and the modulating gas valve, the pressure switch having a first pressure switch inlet in fluid communication with the first outlet of the signal conditioning device, a first pressure switch outlet in fluid communication with the first control port of the gas valve, a second pressure switch inlet in fluid communication with the second outlet of the signal conditioning device, and a second pressure switch outlet in fluid communication with the second port of the gas valve; and wherein the modulating gas valve regulates gas flow to a fuel burning appliance in response to a pressure difference between the first port and the second port of the gas valve, and wherein if the pressure difference drops below a predetermined level, the pressure switch opens to prevent electrical power from being delivered from the power source to the modulating gas valve.

* * * * *